United States Patent [19]

Jakuba et al.

[11] Patent Number: 4,473,047

[45] Date of Patent: Sep. 25, 1984

[54] COMPRESSION RELEASE ENGINE BRAKE

[75] Inventors: Stanislav Jakuba, West Hartford; Walter H. Morse, South Windsor; Nathan Gutman, Simsbury, all of Conn.

[73] Assignee: The Jacobs Mfg. Company, Bloomfield, Conn.

[21] Appl. No.: 124,581

[22] Filed: Feb. 25, 1980

[51] Int. Cl.[3] ..... F02D 13/04

[52] U.S. Cl. ..... 123/323; 123/90.16; 123/90.4; 123/315

[58] Field of Search ..... 123/90.15, 90.16, 90.39, 123/90.4, 90.46, 315, 320, 321, 323, 319, 347

[56] References Cited

U.S. PATENT DOCUMENTS

| | | | |
|---|---|---|---|
| 1,896,163 | 2/1933 | Champion | 123/315 |
| 3,220,392 | 11/1965 | Cummins | 123/321 |
| 3,633,556 | 1/1972 | Inoue | 123/90.4 |
| 3,918,420 | 11/1975 | Villella | 123/315 |
| 4,150,640 | 4/1979 | Egan | 123/321 |

FOREIGN PATENT DOCUMENTS 2055665 5/1972 Fed. Rep. of Germany ..... 123/90.4

OTHER PUBLICATIONS

Institution of Mechanical Engineers; "Retarders for Commercial Vehicles"; Jan. 3, 1974.

*Primary Examiner*—Craig R. Feinberg
*Attorney, Agent, or Firm*—Donald E. Degling

[57] ABSTRACT

An improved compression release engine braking system is provided for internal combustion engines having two exhaust valves associated with each cylinder. The slave piston of the compression release brake is relocated so as to register with one of the two exhaust valves and the crosshead assembly is modified so that actuation of the exhaust valve rocker arms will open both exhaust valves in the normal manner during the fueling mode of engine operation while the slave piston of the compression release brake will open only one of the exhaust valves during the engine braking mode of engine operation.

12 Claims, 5 Drawing Figures

COMPRESSION RELEASE ENGINE BRAKE

BACKGROUND OF THE INVENTION (1) Field of the Invention

This invention relates to engine brakes from use in connection with internal combustion engines of the spark ignition or compression ignition type. More particularly, the invention comprises an improvement in a compression release engine brake designed for use in an engine employing a plurality of exhaust valves for each cylinder.

(2) Prior Art

For many years it has been recognized that vehicles, and particularly trucks, equipped with internal combustion engines of the Otto or Diesel type should be provided with some form of engine retarder in addition to the usual wheel brake. The reason for this is that the momentum of a heavily loaded vehicle descending a long grade may easily overcome the capacity for continuous braking of the wheel braking system. An indication of this condition is the well-known "fading" of the wheel brakes resulting from overheating of the brake linings and drums. Excessive heating may cause permanent damage to the brake lining and drum or even destruction of the lining or drum.

Various types of engine retarders have been developed including hydrokinetic retarders, electrical retarders, compression release engine brakes and exhaust brakes. Each of these types of engine retarder has been described in the book "Retarders For Commercial Vehicles" published by Mechanical Engineering Publications, Ltd. (London, 1974).

The present invention relates particularly to engine retarders of the compression release type in which an engine is converted temporarily into an air compressor by opening the exhaust valves near the end of the compression stroke of the engine. By so opening the exhaust valves out of sequence, the energy used to compress air in the cylinder is released through the exhaust system instead of being recovered during the power stroke of the engine. This energy, known as the retarding horsepower, may be a substantial portion of the power ordinarily developed by the engine during a fueling mode of operation and is effective as a supplemental braking system. The Jacobs engine brake to which the present invention is specifically applicable is described in detail at pp. 23–30 of the publication "Retarders For Commercial Vehicles" referred to above and is described generally in the Cummins U.S. Pat. No. 3,220,392.

SUMMARY OF THE INVENTION

In order to maximize the retarding horsepower which may be developed from an internal combustion engine, it is necessary that a maximum charge of air be drawn into the cylinder and that the exhaust valves be opened at an optimum point close to the top dead center position of the piston in the engine cylinder. Necessarily, when the cylinder pressures are high, a high force is required to open the exhaust valves and this force results in a certain amount of elastic deformation of the parts comprising the exhaust valve train as well as the parts included in the compression release engine brake system. The elastic deformation of the engine parts, in effect, increases the clearance in the exhaust valve train and thus both delays the opening of the exhaust valve and shortens the time that the valve is open, both of which cause a loss in the available retarding horsepower. Elastic deformation can be reduced or overcome in part by the use of high strength materials or by increasing the size and weight of the parts. However, this approach not only increases the cost of the engine and brake system but also may adversely affect the performance of the engine during the fueling mode of operation.

As shown, for example, in FIG. 1, it has been common in engine design for many years to utilize two exhaust valves for each cylinder and to open them by means of a crosshead which is positioned intermediate the exhaust rocker arm and the stems of the exhaust valves. Applicants have discovered that by opening only one of the exhaust valves during engine braking a surprising increase in retarding horsepower can be achieved. The increase in retarding horsepower is accompanied by a decrease in the observed operating pressure in the hydraulic system and is related to a decrease in the overall load in parts of the braking system. To incorporate this discovery into a compression release engine braking system applicants have relocated and redesigned the engine brake slave piston and redesigned the exhaust valve crosshead to permit single valve operation during engine braking and valve operation during engine fueling.

DETAILED DESCRIPTION OF THE DRAWINGS

DESCRIPTION OF THE PREFERRED EMBODIMENT

Figure 1:
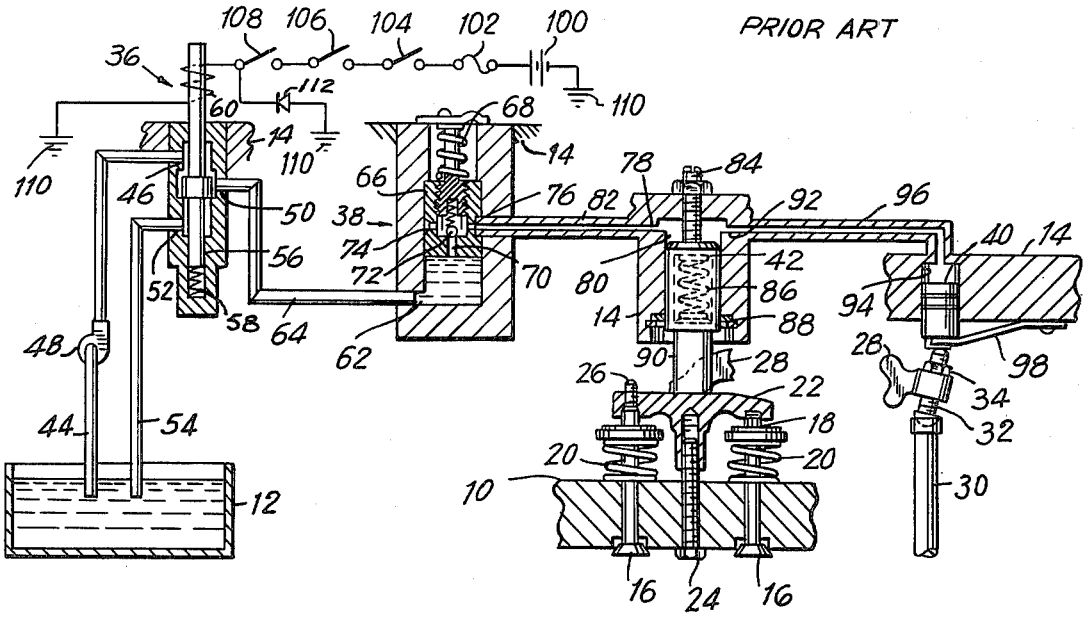
FIG. 1 PRIOR ART
FIG. 1 is a diagrammatic fragmentary sketch, partly in section, of an internal combustion engine having a compression release engine brake operating on the crosshead of the dual exhaust valves in accordance with the prior art.

Reference is first made to FIG. 1 which illustrates, diagrammatically, an internal combustion engine 10 having an oil sump 12 which may, if desired, be the engine crankcase and a compression release engine brake housing 14. As is common in commercial engines of the Otto or Diesel type which are equipped with compression release brakes, each cylinder is provided with two exhaust valves 16 which are seated in the head of the engine 10 so as to communicate between the combustion chamber and the exhaust manifold (not shown) of the engine.

Each exhaust valve 16 includes a valve stem 18 and is provided with a valve spring 20 which biases the valve 16 to the normally closed position. A crosshead 22 is mounted for reciprocating motion in a direction parallel to the axes of the valves 16 on a stud 24. The crosshead 22 is provided with an adjusting screw 26 which registers with the stem 18 of one of the valves 16 to enable the crosshead 22 to act upon both valves simultaneously.

The crosshead 22 is activated by an exhaust valve rocker arm 28 mounted for oscillatory motion on the head of the engine 10. Such oscillatory motion is imparted to the rocker arm 28 by an exhaust pushrod 30 through an adjusting screw 32 threaded into one end of the rocker arm 28 and locked into its adjusted position by a lock nut 34. The pushrod is given a timed vertical reciprocating motion by the camshaft (not shown) of the engine 10. The rocker arm 28 is shown broken away in FIG. 1 to indicate that the pushrod 30 is associated with a cylinder of the engine 10 other than the cylinder associated with exhaust valves 16.

The compression release engine brake comprises, for each cylinder of the engine, a solenoid valve 36, a control valve 38, a master piston 40 and a slave piston 42 together with appropriate hydraulic and electrical auxiliaries as described below. As is well known, the valve timing of many engines is such that the exhaust pushrod for one cylinder will begin its motion at the time the compression release brake must act on another cylinder. Thus, for example, in the Mack 673 engine the location of the master and slave pistons is as shown in Table 1, below:

TABLE 1

| Location of master piston | Location of slave piston |
|---|---|
| No. 1 Pushrod | No. 3 Exhaust Valve |
| No. 5 Pushrod | No. 6 Exhaust Valve |
| No. 3 Pushrod | No. 2 Exhaust Valve |
| No. 6 Pushrod | No. 4 Exhaust Valve |
| No. 2 Pushrod | No. 1 Exhaust Valve |
| No. 4 Pushrod | No. 5 Exhaust Valve |

For compression ignition engines such as the Cummins engine having three cams, the fuel injector pushrod may be used as the motive source since the timing for fuel injection corresponds with the timing for the compression relief engine brake for the same cylinder.

As shown in FIG. 1, the compression release engine brake comprises a low pressure duct 44 communicating between the sump 12 and the inlet portion 46 of the solenoid valve 36 located in the housing 14. A low pressure pump 48 may be located in the duct 44 to deliver oil or hydraulic fluid to the inlet of the solenoid valve 36. The solenoid valve 36 is a three-way valve having, in addition to the inlet port 46, an outlet port 50 and a return port 52 which communicates back to the sump 12 through a return duct 54. The solenoid valve spool 56 is normally biased by a spring 58 so as to close the inlet port 46 and permit the flow of oil or hydraulic fluid from the outlet port 50 to the return port 52. The solenoid coil 60, when energized, drives the valve spool 56 against the bias of spring 58 so as to close the return port 52 and permit the flow of oil or hydraulic fluid from inlet port 46 to outlet port 50.

The control valve 38, also positioned in the brake housing 14, has an inlet port 62 which communicates with the outlet port 50 of the solenoid valve through a duct 64. A control valve spool 66 is mounted for reciprocating motion within the control valve 38 and biased by a compression spring 68. The spool 66 is provided with an inlet port 70, normally closed by a spring biased ball check valve 72, and an outlet port 74 formed to include an annular groove on the outer surface of the spool 66. The control valve 38 also has an outlet port 76 which communicates through a duct 82 with the inlet port 78 of the slave cylinder 80 positioned in the housing 14. When oil or hydraulic fluid flows into the control valve 38, the spool 66 moves until the outlet port 74 of the spool 66 registers with the outlet port 76 of the control valve 38. Thereafter, the check valve 72 opens to permit the oil or hydraulic fluid to flow through the control valve and into the slave cylinder 80.

Slave piston 42 is mounted for reciprocating motion within the slave cylinder 80 and is biased toward the adjustable stop 84 by a spring 86 which acts against a bracket 88 mounted in the housing 14. An extension 90 affixed to the slave piston 42 is adapted to engage the crosshead 22. A clearance of, for example, 0.018 inch may be provided between the crosshead 22 and the extension 90 when the engine is cold and the slave piston 42 is seated against the adjustable stop 84.

An outlet port 92 in the slave cylinder 80 communicates with a master cylinder 94 formed in the housing 14 through a duct 96. The master piston 40 is mounted for reciprocating movement within the master cylinder 94. The exterior end of the master piston 40 registers with one end of the adjusting screw 32 and is lightly biased against the adjusting screw 32 by leaf spring 98.

The control circuit comprises, in series, the vehicle storage battery 100, a fuse 102, a manual switch 104, a clutch switch 106, a fuel pump switch 108, the solenoid coil 60 and ground 110. Preferably, a diode 112 is provided between the fuel pump switch 108 and ground 110. Switches 104, 106 and 108 are provided to permit the operator to shut off the brake entirely, should he desire to do so, to prevent fueling of the engine while the compression release brake is in operation, and to prevent operation of the compression release brake if the clutch should be disengaged.

When the solenoid valve 36 is opened it will be understood that oil or hydraulic fluid may flow through the solenoid valve and the control valve 38 and into the slave cylinder 80 and the master cylinder 94. The initial flow of oil or hydraulic fluid is at a relatively low pressure but the oil or hydraulic fluid which passes through the control valve 38 is prevented from reverse flow by the check valve 72. As the master piston 40 is driven upwardly by the motion of pushrod 30, the hydraulic circuit is pressurized and slave piston 42 is driven downwardly. The downward motion of the slave piston 42 is communicated through extension 90 and crosshead 22 so as to open the valves 16.

So long as the solenoid valve 36 is energized the control valve spool 66 will remain in its upward position where the outlet port 74 of the spool is in registry with the otlet port 76 of the control valve 38. Under these conditions additional oil or hydraulic fluid may enter the slave cylinder 80 and the master cylinder 94 but reverse flow is prevented. Thus the high pressure hydraulic circuit is maintained in operating condition and the motion of the master piston 40 will be communicated through the high pressure hydraulic circuit to the slave piston 42.

However, when the solenoid 60 is de-energized the solenoid valve spool 56 will move to open the connection between the solenoid outlet port 50 and the return port 52. Under this condition the oil or hydraulic fluid in the control valve 38 will flow back toward the sump 12 and the control valve spool 66 will be moved downwardly by the spring 68. When the control valve spool 66 is in its non-operating position, the control valve outlet port 76 will be exposed and the oil or hydraulic fluid in the slave cylinder 80 and the master cylinder 94 may be exhausted past the control valve spool 66 and returned to the sump 12 through ducts (not shown).

As noted above, the compression release braking system described in connection with FIG. 1 operates on both exhaust valves 16 for each cylinder of the engine 10. In tests conducted on such a system it was noted that when a retarding horsepower of 260 H.P. was developed, the pressure in the hydraulic system reached the very high level of 6300 psi. While when operating in the fueling mode it is necessary to open both exhaust valves, applicants believed that it might not be necessary to open both exhaust valves during operation of the compression release brake. Accordingly, applicants redesigned the slave piston of the compression release brake and the crosshead of the engine so that when the compression release brake was operated only one exhaust valve would be opened, but that when the engine was fueled both valves would be operated in the normal manner.

The surprising result of this modification was that when the compression release brake was operated so as to produce a retarding horsepower of 260 H. P., the pressure in the hydraulic system was only 2500 psi. Moreover, when the compression release brake was operated to produce a retarding horsepower of 439 H. P., the pressure in the hydraulic system rose only to about 3250 psi. Thus, while the retarding horsepower was increased by about two thirds the resulting pressure was decreased by about one half. The decrease in the hydraulic pressure means that the load on the various engine parts as well as the components of the compression release brake has been substantially reduced with a corresponding reduction in the elastic deformation of the various engine and brake components. In effect, the brake system and the exhaust valve train have become stiffer. A measure of the increase in stiffness was that when both exhaust valves were operated by the compression release brake, the valves were observed to open at 24 degrees before piston top dead center. However, when the system was modified so that only one exhaust valve was opened, the valve opened at 29 degrees before piston top dead center. It is believed that the increase in stiffness also helped to reduce the loading because the degree of compression within the cylinder was decreased.

Figure 2:
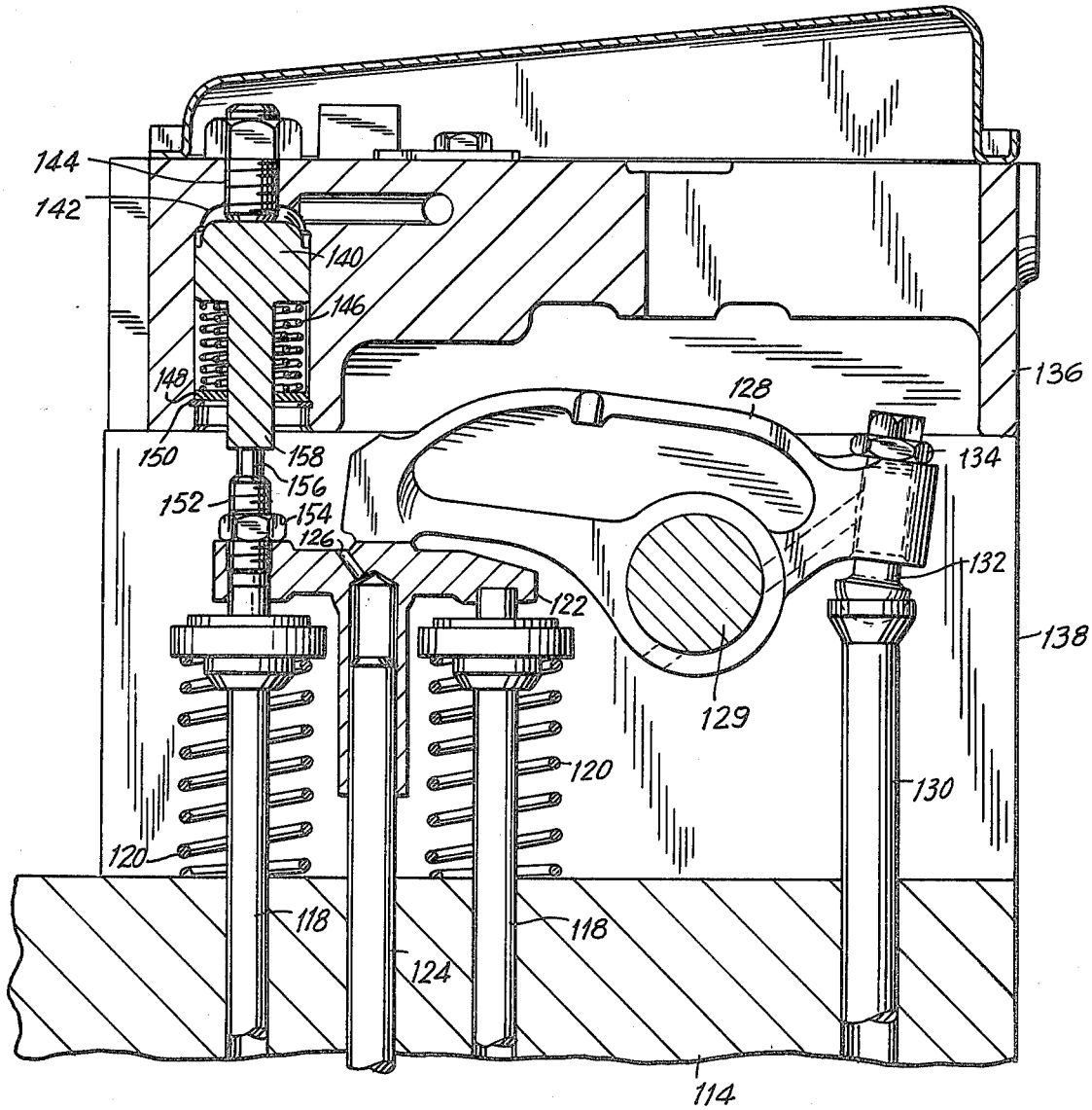
FIG. 2 is a fragmentary cross sectional view showing a compression release engine brake in accordance with the present invention which acts upon a single exhaust valve.

FIG. 2, to which reference is now made, illustrates the application of a modified Jacobs compression release brake as applied to a modified Cummins diesel engine. The engine 114 contains the original exhaust valves having valve stems 118 and biased by valve springs 120. The crosshead 122 is mounted on a stud 124 for vertical reciprocating movement. An oil relief passage 126 is formed in the crosshead 122. The crosshead is driven by the exhaust valve rocker arm 128 which is mounted for oscillatory movement on a rocker arm shaft 129. The exhaust pushrod 130 drives the rocker arm 128 through an adjusting screw 132 locked into the adjusted position by a lock nut 134. The compression release brake housing 136 is located above the engine 114 by a spacer 138. Slave piston 140 is mounted within the slave cylinder 142 and positioned so as to be substantially parallel with the stem 118 of one of the exhaust valves. The slave piston 140 is biased upwardly against an adjustable stop 144 by a spring 146 which acts against a plate 148 positioned within the slave cylinder 142 by a snap ring 150.

A hollow adjusting screw 152 is threaded into the crosshead 122 and locked in its adjusted position by a lock nut 154. The hollow adjusting screw 152 is positioned parallel and, preferably, coaxially with the axis of the valve stem 118. It will be understood that the annular end of the hollow adjusting screw 152 will contact and drive the valve stem 118 whenever the crosshead 122 is reciprocated by the rocker arm 128. A pin 156 adapted to slide coaxially within the hollow adjusting screw 152 extends upwardly to approach the lower end of an extention 158 of the slave piston 140. It will be appreciated that downward movement of the slave piston 140 will cause the pin 156 to move axially and drive the valve stem 118 downwardly thereby opening only one of the two exhaust valves. While pin 156 has been described as separate from the valve stem 118, it will be understood that the pin 156 may be integral with the valve stem 118, though of smaller diameter.

Figure 3:
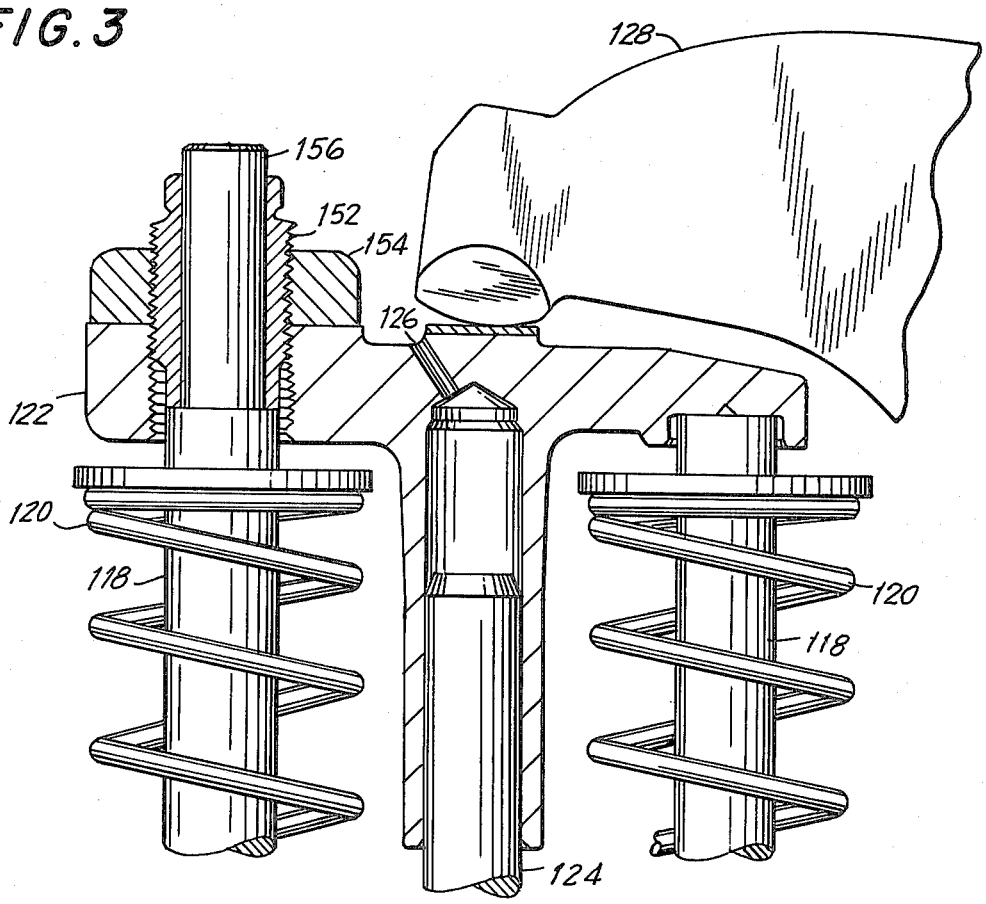
FIG. 3 is a fragmentary cross section on an enlarged scale of the exhaust valve and crosshead assembly shown in FIG. 2.

FIG. 3 shows, on a larger scale, the detail of the crosshead 122, hollow adjusting screw 152, and pin 156. From this detail it will be apparent that the crosshead 122 functions in its normal manner to open both exhaust valves when the engine is operating in a fueling mode while only one exhaust valve is opened during a compression release braking mode of operation.

Figure 4:
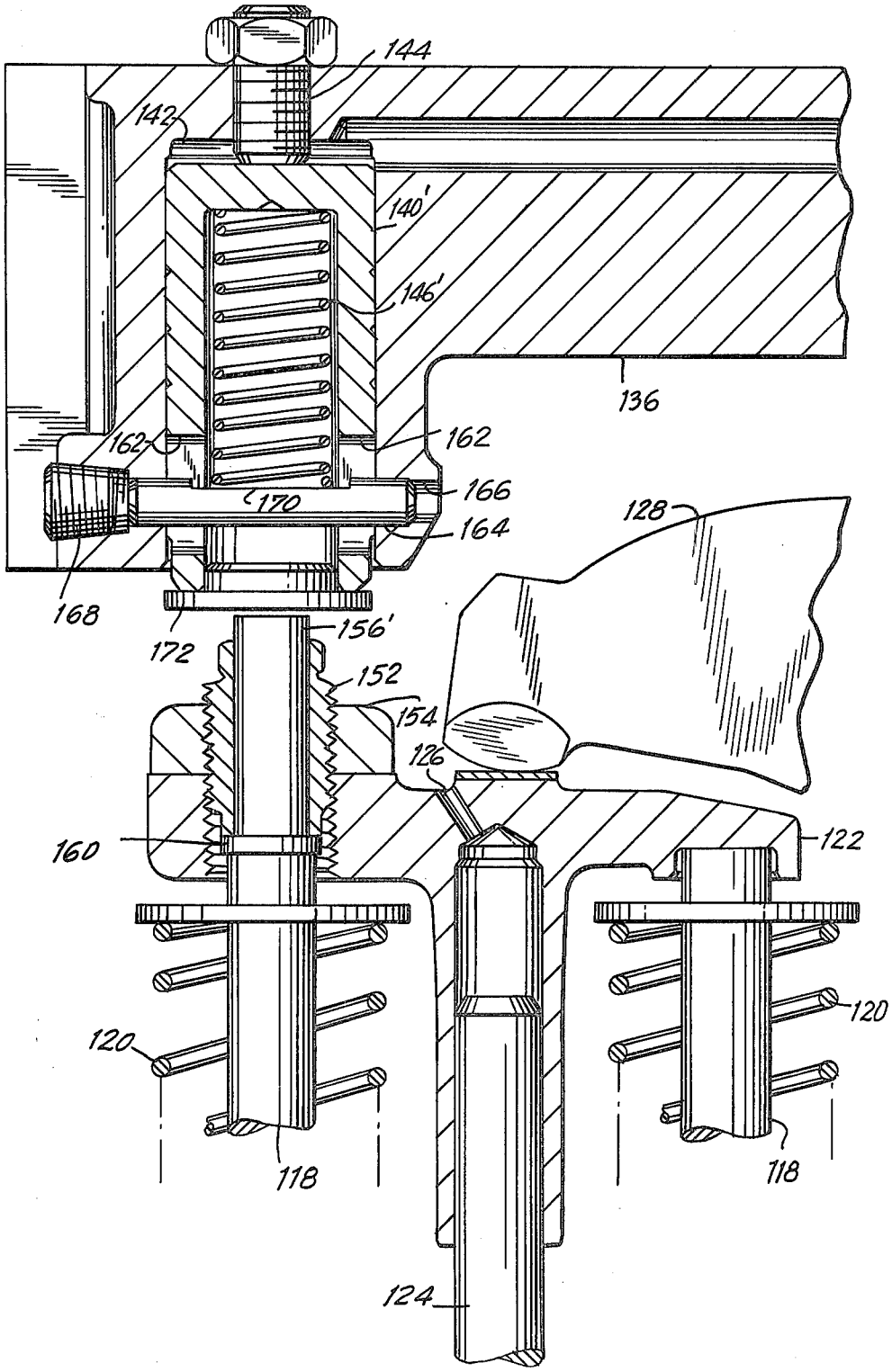
FIG. 4 is a fragmentary cross sectional view of a modified slave piston and crosshead assembly in accordance with the present invention.

FIG. 4 shows, on a larger scale, a modification of the invention shown in FIG. 2. Parts common to both structures bear the same identification. Pin 156' is provided, at its lower end, with an integral collar 160 which serves to restrain the pin 156' from upward motion while permitting it to function in the same manner as the pin 156. The slave piston 140' is provided with axially disposed slots 162 aligned along a diameter of the piston 140'. A pin 164 is positioned in a bore 166 formed in the housing 136 and held in place by a set screw 168. The pin 164 may have a flat 170 formed on one side to engage with the spring 146'. A plug 172 may be driven into the open end of the slave piston to serve as an impact surface to drive the pin 156'. It will be noted that a slight clearance is provided between the plug 172 and the upper end of the pin 156' to allow for thermal expansion of the exhaust valve stem 118.

Figure 5:
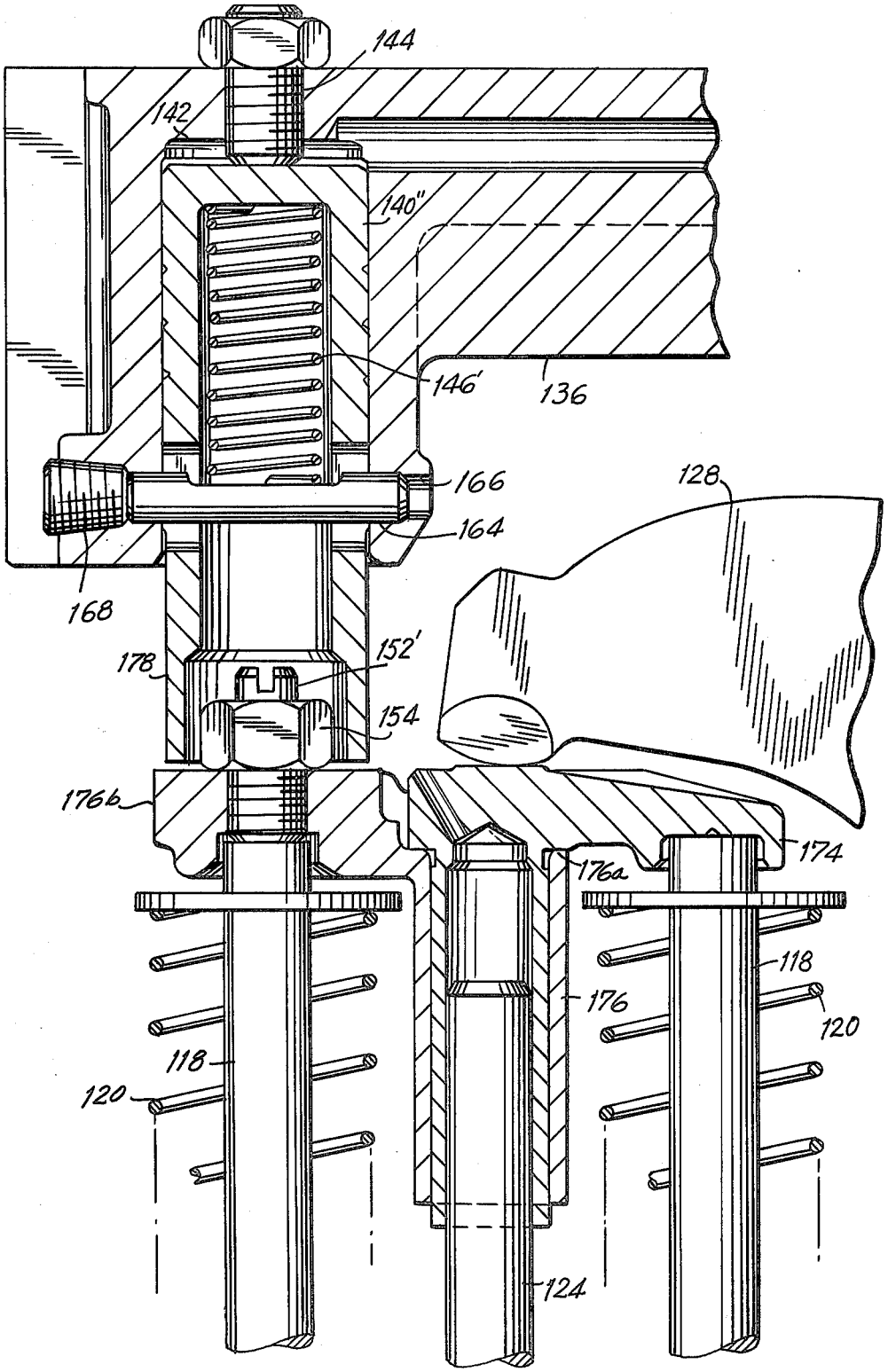
FIG. 5 is a fragmentary cross sectional view of a slave piston of a still further modification of the slave piston and crosshead assembly in accordance with the present invention.

A still further modification of the present invention is illustrated in FIG. 5 wherein parts common to FIGS. 2, 3 and 4 bear the same identification. In this form of the invention, the means by which only one of the two exhaust valves is opened comprises a tubular member 176 having a driven collar portion **176*a* and an offset driving collar portion 176*b* parallel with the slave piston 140" and the stem 118 of one of the exhaust valves. An adjusting screw 152' also parallel with the slave piston 140" and the stem 118 of one of the exhaust valves is locked into its adjusted position by lock nut 154. The tubular member 176 slidably engages a tubular portion of the crosshead 174 and is driven by the crosshead 174 through the collar portion 176*a*. The slave piston 140" is provided with a skirt 178 adapted to clear the adjusting screw 152' and the lock nut 154 so as to engage and drive the collar 176*b* of the tubular member 176. Thus, the slave piston 140" will, upon actuation, open only one of the exhaust valves but the rocker arm 128 will drive both the crosshead 174 and the tubular member 176** so as to open both exhaust valves.

By reason of the lower hydraulic pressure and the lower loads present in a compression release brake system incorporating the present invention, it will be appreciated that lower strength components may be employed with concomitant savings in the cost of the brake while simultaneously increasing the performance in terms of the effective retarding horsepower by amounts of the order of 50%.

The terms and expressions which have been employed are used as terms of description and not of limitation and there is no intention in the use of such terms and expressions of excluding any equivalents of the features shown and described or portions thereof, but it is recognized that various modifications are possible within the scope of the invention claimed.

What is claimed is:

1. An engine braking system of the gas compression release type including an internal combustion engine having at least two exhaust valves associated with each cylinder, rocker arm means associated with each cylinder, crosshead means intermediate with each of said rocker arm means and said exhaust valves, hydraulically actuated reciprocating piston means, means for applying hydraulic pressure to one end of said piston means at a predetermined time, and actuating means guided by said crosshead means and interposed between said piston means and only one of said exhaust valves, said actuating means mounted for reciprocating movement with respect to said crosshead means whereby said one of said exhaust valves is opened by the motion of said piston means driving said actuating means against said one of said exhaust valves.

2. Apparatus as described in claim 1 in which said piston means is substantially parallel with said one of said exhaust valves.

3. Appartus as described in claim 2 and comprising, in addition, hollow adjusting screw means threaded into said crosshead means substantially parallel with said one of said exhaust valves and having an annular end surface, in which said actuating means comprises pin means slidably positioned within said hollow adjusting screw means and adapted to engage at one end with said piston means, said pin means having an enlarged collar formed on the opposite end thereof, the annular surface of said collar adapted to engage with the annular end surface of said hollow adjusting screw and the opposite surface of said collar adapted to engage with said one of said exhaust valves.

4. Apparatus as described in claim 2 in which said actuating means comprises a first collar portion slidably engageable with said crosshead means and adapted to be driven thereby and a second collar portion engageable with said piston means and adapted to be driven thereby and comprising, in addition, adjusting screw means threaded into said actuating means substantially parallel with said one of said exhaust valves and having an end surface adapted to engage said one of said exhaust valves.

5. Apparatus as described in claim 2 and comprising, in addition, hollow adjusting screw means threaded into said crosshead means substantially parallel with said one of said exhaust valves and having an annular end surface adapted to engage with said one of said exhaust valves and in which said actuating means comprises pin means slidably positioned within said hollow adjusting screw means and adapted to engage at one end thereof with said piston means and at the other end thereof with said one of said exhaust valves.

6. Apparatus as described in claim 5 in which said pin means is formed integral with said one of said exhaust valves.

7. In an engine braking system of the gas compression release type comprising an internal combustion engine having at least two exhaust valves associated with each cylinder, rocker arm means associated with each cylinder, crosshead means intermediate each of said rocker arm means and said exhaust valves, hydraulically actuated reciprocating piston means and means for applying hydraulic pressure to one end of said piston means at a predetermined time, the improvement comprising actuating means guided by said crosshead means and interposed between said piston means and only one of said exhaust valves, said actuating means mounted for reciprocating movement with respect to said crosshead means whereby said one of said exhaust valves is opened by the motion of said piston means driving said actuating means against said one of said exhaust valves.

8. Apparatus as described in claim 7 in which said piston means is substantially parallel with said one of said exhaust valves.

9. Apparatus as described in claim 8 and comprising, in addition, hollow adjusting screw means threaded into said crosshead means, substantially parallel with said one of said exhaust valves and having an annular end surface, in which said actuating means comprises pin means slidably positioned within said hollow adjusting screw means and adapted to engage at one end with said piston means, said pin means having an enlarged collar formed on the opposite end thereof, the annular surface of said collar adapted to engage with the annular end surface of said hollow adjusting screw and the opposite surface of said collar adapted to engage with said one of said exhaust valves.

10. Apparatus as described in claim 8 in which said actuating means comprises a first collar portion slidably engageable with said crosshead means and is adapted to be driven thereby and a second collar portion engageable with said piston means and adapted to be driven thereby and comprising, in addition, adjusting screw means threaded into said actuating means substantially parallel with said one of said exhaust valves and having an end surface adapted to engage said one of said exhaust valves.

11. Apparatus as described in claim 8 and comprising, in addition, hollow adjusting screw means threaded into said crosshead means substantially parallel with said one of said exhaust valves and having an annular end surface adapted to engage with said one of said exhaust valves and in which said actuating means comprises pin means slidably positioned within said hollow adjusting screw means and adapted to engage at one end thereof with said piston means and at the other end thereof with said one of said exhaust valves.

12. Apparatus as described in claim 11 in which said pin means is formed integral with said one of said exhaust valves.

* * * * *